US007300340B1

(12) United States Patent
Elmufdi et al.

(10) Patent No.: US 7,300,340 B1
(45) Date of Patent: Nov. 27, 2007

(54) CMP PAD HAVING OVERLAID CONSTANT AREA SPIRAL GROOVES

(75) Inventors: Carolina L. Elmufdi, Glen Mills, PA (US); Gregory P. Muldowney, Earleville, MD (US)

(73) Assignee: Rohm and Haas Electronics Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/512,699

(22) Filed: Aug. 30, 2006

(51) Int. Cl.
*B24D 11/00* (2006.01)

(52) U.S. Cl. ..... 451/527; 451/530

(58) Field of Classification Search ..... 451/526–539, 451/548–551
See application file for complete search history.

(56) References Cited

U.S. PATENT DOCUMENTS 5,650,039 A 7/1997 Talieh
6,089,966 A * 7/2000 Arai et al. ..... 451/533
6,120,366 A * 9/2000 Lin et al. ..... 451/550
6,159,088 A 12/2000 Nakajima
6,749,714 B1 * 6/2004 Ishikawa et al. ..... 156/345.12
6,783,436 B1 8/2004 Muldowney
2007/0032182 A1 * 2/2007 Suzuki ..... 451/527

FOREIGN PATENT DOCUMENTS

JP 2001138212 A 5/2001

* cited by examiner

*Primary Examiner*—Dung Van Nguyen
(74) *Attorney, Agent, or Firm*—Blake T. Biederman

(57) ABSTRACT

A circular chemical mechanical polishing pad that includes a polishing surface having a concentrically located origin. The polishing surface includes groove sets each containing grooves arranged in a pattern in which ones of the grooves in one groove set cross ones of the grooves in another set. The grooves in each groove set are configured and arranged so that the fraction of the polishing surface that is grooved, as measured along any circle that is concentric with the origin and crosses the grooves, is substantially constant, i.e., within about 25% of its average.

10 Claims, 11 Drawing Sheets

CMP PAD HAVING OVERLAID CONSTANT AREA SPIRAL GROOVES

BACKGROUND OF THE INVENTION

The present invention generally relates to the field of chemical mechanical polishing (CMP). In particular, the present invention is directed to a CMP pad having overlaid constant area spiral grooves.

In the fabrication of integrated circuits and other electronic devices on a semiconductor wafer, multiple layers of conducting, semiconducting and dielectric materials are deposited onto and etched from the wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization and polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

More particularly, a number of prior art groove patterns for rotational polishing pads include grooves that cross one another one or more times. For example, U.S. Pat. No. 5,650,039 to Talieh discloses in its FIG. 3 a circular polishing pad having spiral or circular arcuate groove segments arranged so that immediately adjacent segments wind in opposite directs and cross one another. Japan Patent Publication No. 2001-138212 to Doi et al. discloses a circular polishing pad having two sets of spiral grooves that extend from proximate the concentric center of the pad to the edge of the pad and cross one another several times along their lengths. While these groove patterns are known, polishing pad designers are continually seeking groove patterns that make the polishing pads more effective and useful relative to known pads.

STATEMENT OF THE INVENTION

In one aspect of the invention, a polishing pad comprises a polishing layer configured for polishing at least one of a magnetic, optical and semiconductor substrate in the presence of a polishing medium, the polishing layer including a circular polishing surface having a concentric center and an outer periphery; at least one first groove formed in the circular polishing surface; and at least one second groove formed in the circular polishing surface so as to cross the at least one first groove at least twice so as to define at least one four-sided landing having four curved sides; wherein each of the at least one first groove and the at least one second groove provide the circular polishing surface with a respective circumference fraction grooved from a first location proximate the concentric center to a second location proximate the outer periphery, the respective circumference fraction grooved having an average and remaining within about 25% of the average.

In another aspect of the invention, a polishing pad comprises a polishing layer configured for polishing at least one of a magnetic, optical and semiconductor substrate in the presence of a polishing medium, the polishing layer including a circular polishing surface having a concentric center and an outer periphery; a first groove set having a first starting radius and containing a plurality of first grooves formed in the circular polishing surface, each of the plurality of first grooves laid out in accordance with a set of constant circumference fraction grooved equations as a function of the first starting radius so as to provide a first circumference fraction grooved having a first average and remaining within about 5% of the first average; and a second groove set having a second starting radius and containing a plurality of second grooves formed in the circular polishing surface so that ones of the plurality of first grooves cross ones of the plurality of second grooves at least once so as to define a plurality of four-sided landings each having four curved sides, each of the plurality of second grooves laid out in accordance with the set of constant circumference fraction grooved equations as a function of the second starting radius so as to provide a second circumference fraction grooved having a second average and remaining within about 5% of the second average.

DETAILED DESCRIPTION OF THE INVENTION

Figure 1:
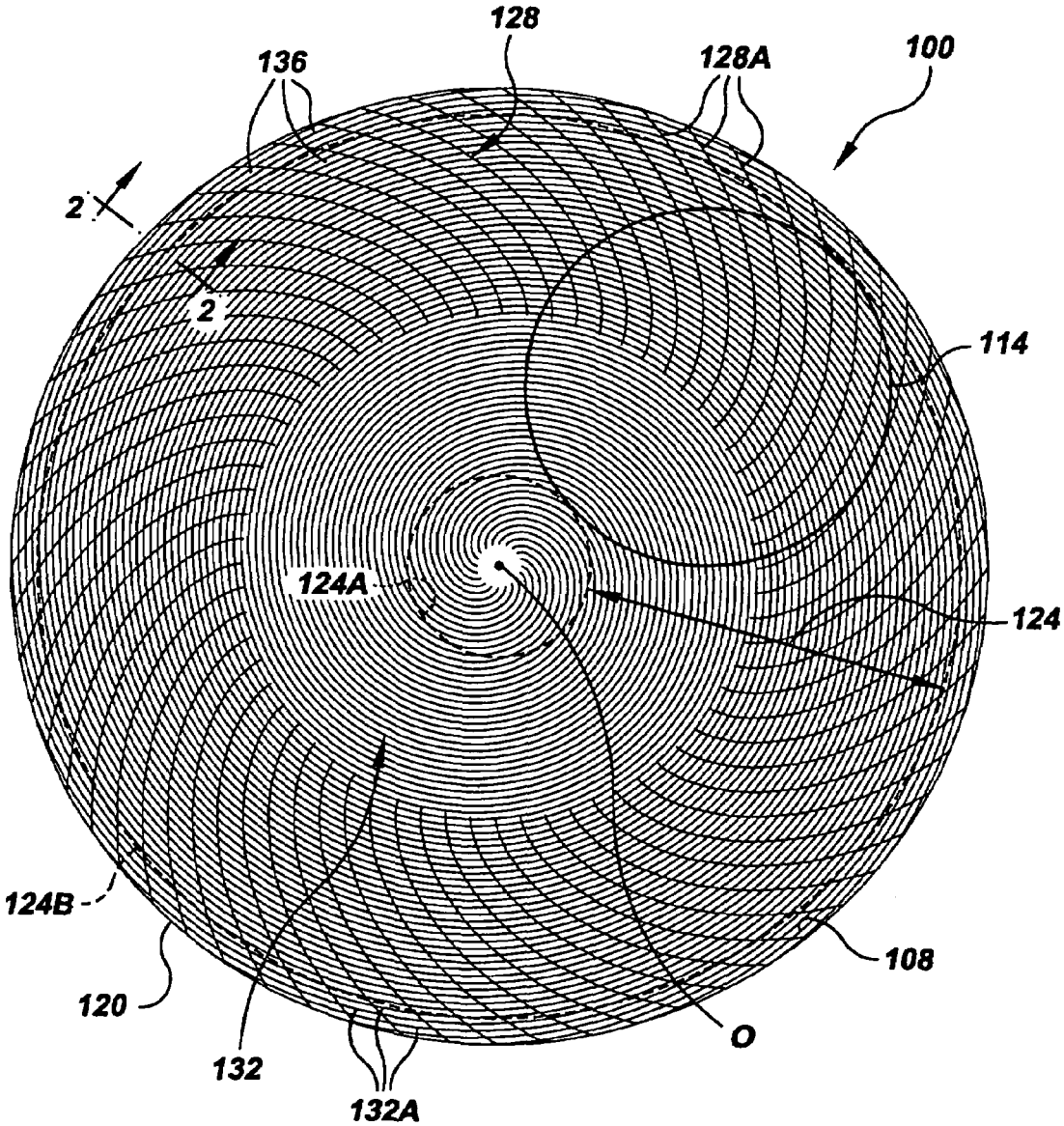
FIG. 1 is a plan view of a polishing pad made in accordance with the present invention so as to have two sets of crossing grooves.
Figure 2:
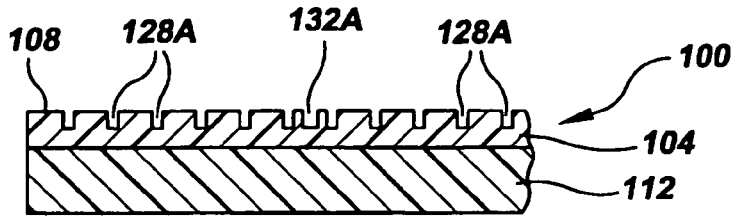
FIG. 2 is an enlarged cross-sectional view of the polishing pad of FIG. 1 as taken along line 2-2 of FIG. 1.
Figure 3:
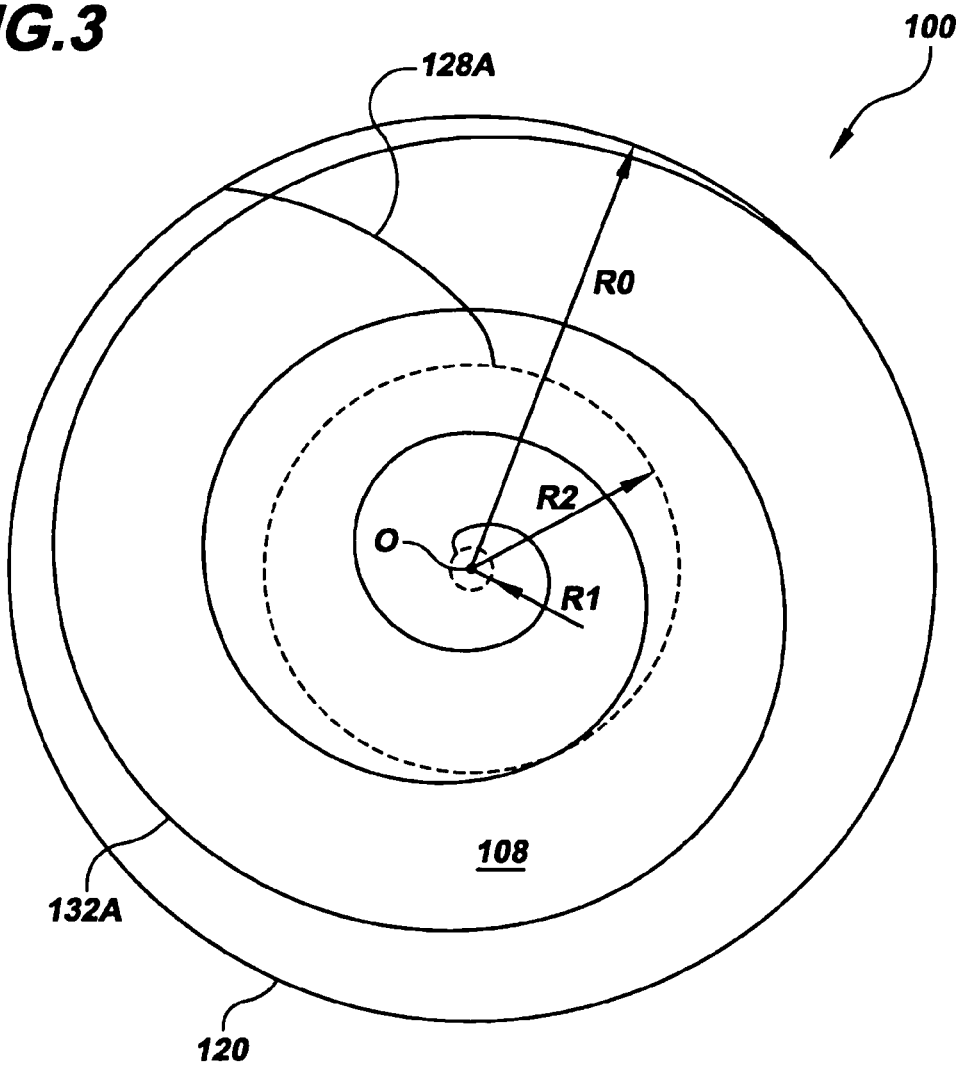
FIG. 3 is a schematic view of the polishing pad of FIG. 1 showing one groove from each of the two sets of crossing grooves.

Referring to the drawings, FIGS. 1-3 illustrate a polishing pad 100 made in accordance with the present invention that, as described below in more detail, may be used with a CMP polishing machine. As seen in FIG. 2, polishing pad 100 includes a polishing layer 104 having a polishing surface 108. Polishing layer 104 may be supported by a backing layer 112, which may be formed integrally with the polishing layer or may be formed separately from the polishing layer. Polishing layer 104 may be made out of any material suitable for polishing the article being polished, such as a semiconductor wafer (indicated by outline 114 in FIG. 1), magnetic media article, e.g., a disk of a computer hard drive or an optic, e.g., a refractive lens, reflective lens, planar reflector or transparent planar article, among others. Examples of materials for polishing layer 104 include, for the sake of illustration and not limitation, various polymer plastics, such as a polyurethane, polybutadiene, polycarbonate and polymethylacrylate, among many others.

As seen in FIGS. 1 and 3, polishing pad 100 typically has a circular disk shape so that polishing surface 108 has a concentric center, or origin O, and a circular outer periphery 120 located a distance Ro (FIG. 3) from origin O. During use, the article being polished (here, a wafer as indicated by outline 114), which is typically, but not necessarily a semiconductor wafer, sweeps out a circular polishing (wafer) track 124 on polishing surface 108 as polishing pad 100 is rotated about origin O. Polishing track 124 is that portion of polishing surface confronted by the polished article during polishing. Polishing track 124 is generally defined by an inner boundary 124A and an outer boundary 124B. As those skilled in the art will readily appreciate, inner and outer boundaries 124A-B of wafer track 124 are largely circular, but may be considered to be undulated in the case of a polisher that imparts an orbital or oscillatory motion to the polished article or polishing pad 100.

Referring to FIGS. 1-3, polishing pad 100 includes two groove sets 128, 132 each containing a plurality of corresponding respective grooves 128A, 132A. Importantly, and as discussed below in detail, each groove 128A is configured and located to cross ones of grooves 132A, and each groove 128A, 132A is a substantially "constant area" groove. In a truly constant area groove, the ratio of the length of the segment of a circle that crosses the groove from one side of the groove to the other to the length of the complementary segment of the circle outside of the groove is the same value regardless of the radius of the circle. Consequently, the fraction of polishing surface 108 that is grooved by each set 128, 132 of grooves 128A, 132A, as measured along any circle that is concentric with origin O and crosses the grooves in that set, is substantially constant, i.e., within about 25% of the average, throughout that set. This concept will be referred to herein as "circumference fraction grooved," or simply "CF." Each groove 128A, 132A may have virtually any cross-sectional shape and cross-sectional size desired to suit a particular set of design criteria. Thus, the rectangular cross-sectional shape of grooves 128A, 132A, as particularly illustrated in FIG. 2, and the relative cross-sectional size shown are merely illustrative. Those skilled in the art will understand the wide range of shapes and sizes of grooves 128A, 132A that a designer may provide to a polishing pad of the present invention, such as pad 100. Those skilled in the art will also readily understand that the cross-sectional shapes and sizes of grooves 128A, 132A may vary either along the length of each groove or from groove to groove, or both. Grooves 132A in groove set 132 extend through polishing track 124, crossing both inner boundary 124A and outer boundary 124B, while grooves 128A in set 128 cross only outer boundary 124B. As those skilled in the art will readily appreciate, whether or not grooves 128A, 132A of either set 128, 132 extend across one or both boundaries 124A-B is a function of the polishing needs that polishing pad 100 is designed to satisfy.

A constant CF may be achieved for each set 128, 132 of grooves 128A, 132A by laying out the corresponding respective grooves on the basis of the following equations, which define a spiral shape:

$$X=R\cos\phi(R);\text{ and} \qquad \text{Equation \{1\}}$$

$$Y=R\sin\phi(R), \qquad \text{Equation \{2\}}$$

where R is the distance from the pad center and ø is the angle in a polar coordinate system fixed at this center, and wherein $$\phi(R)=\sqrt{\left(\frac{R}{R_s}\right)^2-1}+\sin^{-1}\left(\frac{R_s}{R}\right)-\frac{\pi}{2} \qquad \text{Equation \{3\}}$$

with $R_S$ the starting radius of the spiral. Equations {1} through {3} are referred to hereinafter and in the appended claims as either the "set of constant circumference fraction grooved equations" or simply the "CF equations."

As seen from the CF equations above, the variable that defines the curvature of grooves 128A, 132A is $R_S$, which is the inner, or starting, radius for the corresponding groove set. As readily seen in FIG. 3 in which R1 is the starting radius for each groove 132A and R2 is the starting radius for each groove 128A, the smaller the starting radius, the greater the number of winding turns the respective grooves make around origin O. With the relatively small starting radius R1, each groove 132A makes more than three winding turns around origin O, whereas each groove 128A, which has a relatively large starting radius R2, sweeps out about one-twelfth of a winding turn around the origin. While the starting radius of each groove set 128, 132 (FIG. 1) may be any value from zero, where the grooves would start at origin O, to just less than outer radius Ro of polishing pad 100, practically speaking, one of the starting radii (R1 in FIG. 3) will typically, though not necessarily, be less than the radius of inner boundary 124A (FIG. 1) of wafer track 124 and another of the starting radii, (R2 in FIG. 3) will typically, though not necessarily, be less than the radius of outer boundary 124B (FIG. 1) of the wafer track. For adjusting wafer uniformity, the small starting radius R1 is preferably outside the wafer track and the relatively large starting radius R2 is within the wafer track. This allows adjustment and fine tuning of the polishing for improving within wafer uniformity.

In one exemplary set of embodiments of polishing pads made in accordance with the present invention, it may be desired that the grooves of at least one groove set wind at least two full turns around origin O. Using the CF equations above, this requires the starting radius of such grooves to be less than about 1/12 of the pad radius R0. For a 300-mm wafer polisher the pad radius may be approximately 15" (381 mm), hence the starting radius must be about 1.25 inches (31.7 mm) to result in two full turns of the spiral groove. In another exemplary set of embodiments, it may be desired that the grooves in at least one groove set wind no more than one turn around origin O. This requires that the starting radius in the CF equations be no less than 1/3 of the pad radius R0, or for the 300-mm pad noted above, 5 inches (127 mm). In yet other embodiments, it may be desirable that the grooves in one groove set wind at least two full turns while the grooves in the other set wind no more than one turn. Of course, those skilled in the art will readily appreciate that still other embodiments may satisfy other winding requirements as desired.

Grooves formed substantially consistently with the CF equations result in constant CF spiral grooves 128A, 132A, which translate into provision of a substantially constant area of polishing surface 108 as a function of radius R for each groove set 128, 132 (FIG. 1), which, in turn, can translate into more uniform polishing performance than a polishing pad having groove sets with a non-constant, or substantially non-constant, CF. The primary advantage of a constant CF is the establishment of a slurry film between the wafer and pad having substantially uniform thickness from point to point that causes forces on the wafer to balance with the wafer exactly parallel to the mean plane of the pad. By contrast, a non-constant CF leads to point-to-point variations in the hydrodynamic state between the pad and wafer, resulting in wafer tilt and correspondingly non-uniform material removal. The actual percentage of the CF for each groove set 128, 132 will depend on the number of grooves 128A, 132A at any given radius, widths of the grooves at that radius and the curvature of the grooves at that radius. It is noted that while the CF may be virtually any percentage, experience to date has shown that a combined CF, i.e., the sum of the CF for groove set 128 and the CF for groove set 132, in the range of about 10% to about 45% provides good performance for semiconductor wafer polishing. In addition, as mentioned the present disclosure allows for grooves having a wide range of curvatures. In polishing pad 100, each groove 128A sweeps out only about $1/12^{th}$ of a winding turn around origin O, while each groove 132A sweeps out over three winding turns. Of course, smaller and larger sweeps may be used as needed to suit a particular design.

Other variables for configuring and arranging grooves 128A, 132A in corresponding respective sets 128, 132 include the number of grooves, the direction of curvature of the grooves, and the starting and ending points of the grooves in each set. Regarding the number of grooves 128A, 132A, a designer may provide as few as one groove in each set 128, 132 and as many in each set as desired. Of course, there are practical limits as to the maximum number of grooves 128A, 132A that can physically be fit onto polishing surface 108. The direction of curvature of the grooves, in this example grooves 128A, 132A, as between the two sets, here sets 128, 132, is up to the designer. Depending on the design, one set of grooves may wind in the same direction about origin O as the other set or may wind in the opposite direction from the other set. If both sets wind in the same direction, they may wind either clockwise or counterclockwise.

Figure 6:
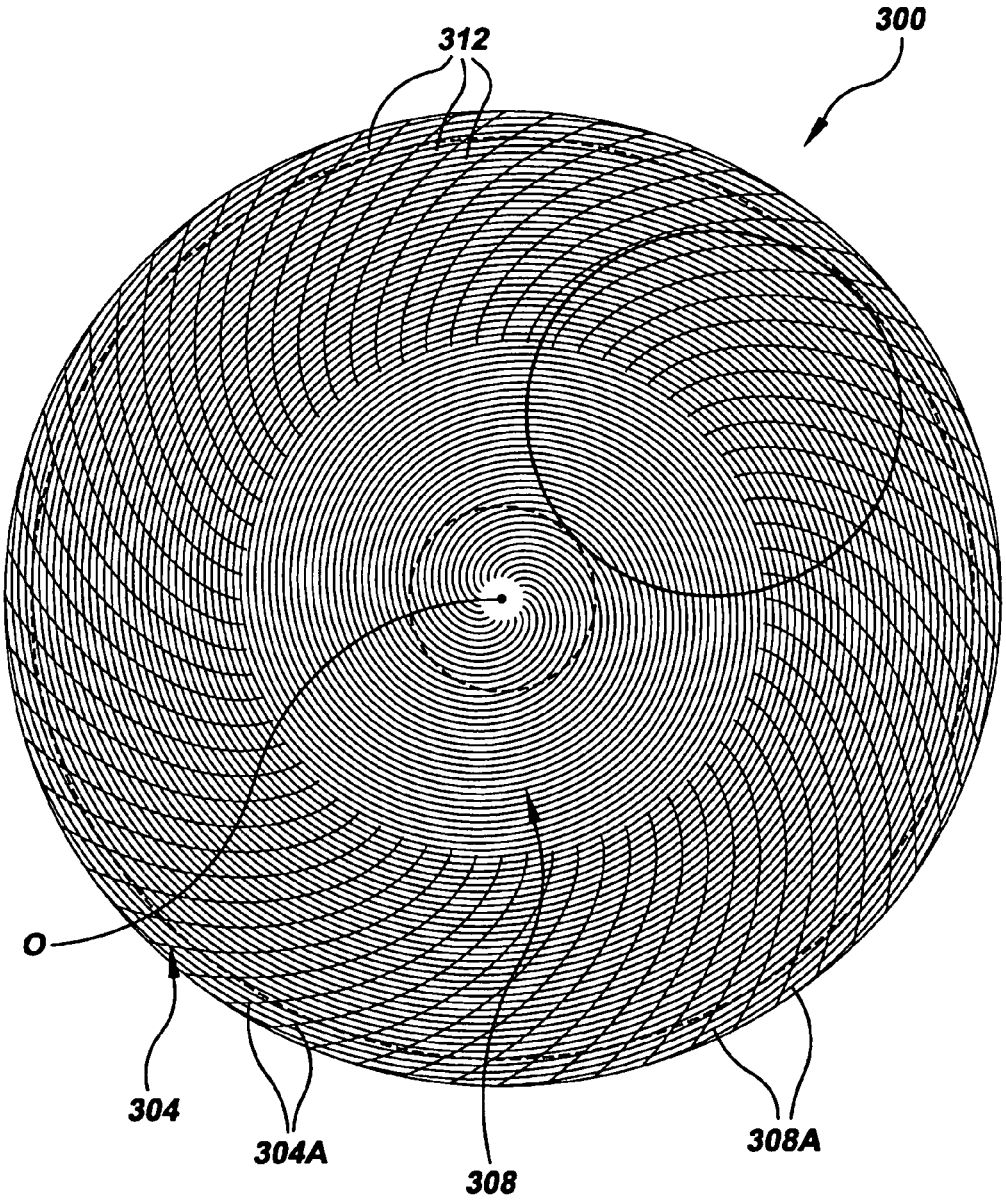
FIG. 6 is a plan view of another alternative polishing pad made in accordance with the present invention so as to have two sets of crossing grooves.
Figure 7:
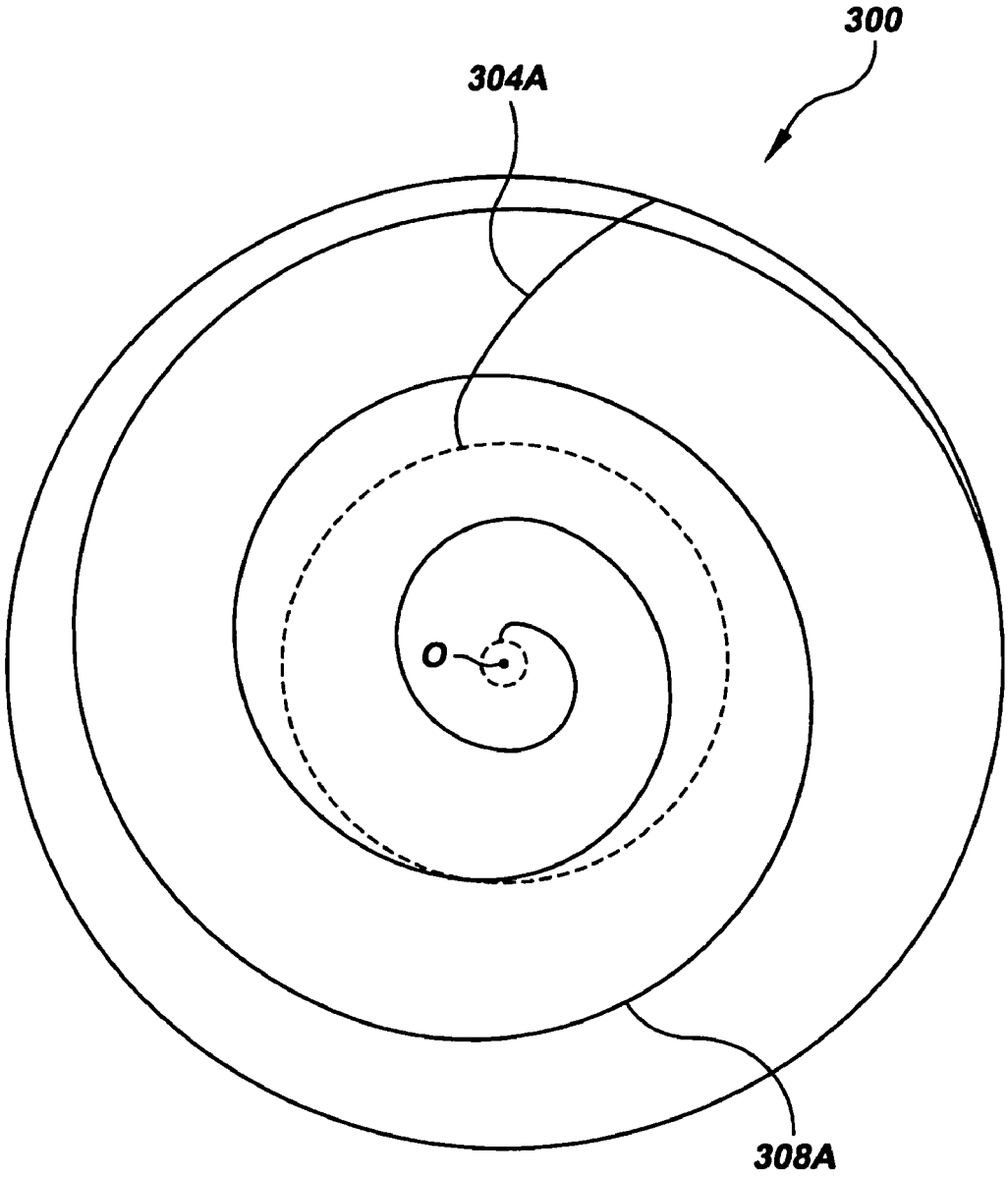
FIG. 7 is a schematic view of the polishing pad of FIG. 6 showing one groove from each of the two sets of crossing grooves.

In this connection, it is noted that due to the nature of the foregoing CF equations if both groove sets wind in the same direction, e.g., as in grooves sets 304, 308 of FIGS. 6 and 7, the grooves in the respective sets must start at different starting radii. If the starting radii are identical, the grooves winding in the same direction will have the same curvature and, thus, will not cross each other. Of course, the crossing of grooves winding in opposite directions is an intrinsic feature as long as the radial extents of the grooved regions of the respective groove sets sufficiently overlap.

While in exemplary polishing pad 100 of FIGS. 1-3 the value of CF for each groove set 128, 132 is constant based on laying out grooves 128A, 132A using the CF equations, in other embodiments CF may be somewhat non-constant. In these embodiments, it is preferred that the CF of each groove set remain within about 25% of its average value as a function of pad radius and, preferably, remain within about 10% of its average value. Most preferably, the CF remains within 5% of its average value as a function of pad radius; and ideally, the CF remains constant of its average value as a function of pad radius. It is most important to maintain the CF stable in its intended polishing region. For example, when polishing wafers, the CF preferably remains stable within the wafer track. These limits on CF allow for, among other things, variations from ideal groove formation (e.g., relaxing the groove design tolerance to make the process of forming the grooves less expensive and less time consuming), and for compensation of any polishing effects that are a function of radius of the polishing pad (e.g., material removal as a function of slurry distribution).

As can be readily seen in FIG. 1, crossing groove sets 128, 132 define a plurality of four-sided landings 136 each bounded by four segments of corresponding respective ones of grooves 128A, 132A. In the embodiment shown, wherein grooves 128A, 132A are spiral in shape, each of the four sides of each four-sided landings 136 is curved. It is also readily seen that the areas of four-sided landings 136 increase with increasing radial distance between the landings and center O of polishing pad 100.

Figure 4:
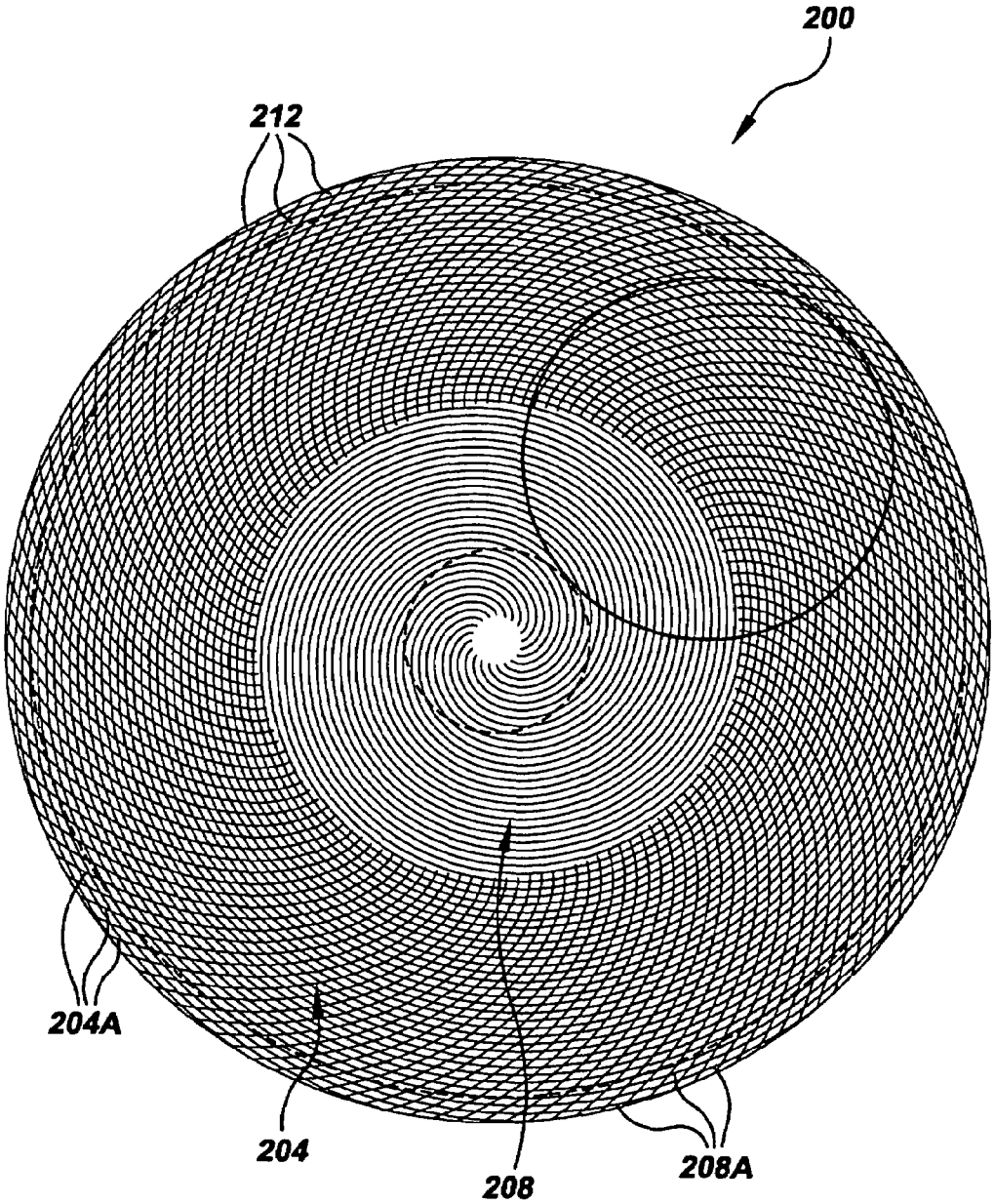
FIG. 4 is a plan view of an alternative polishing pad made in accordance with the present invention so as to have two sets of crossing grooves.
Figure 5:
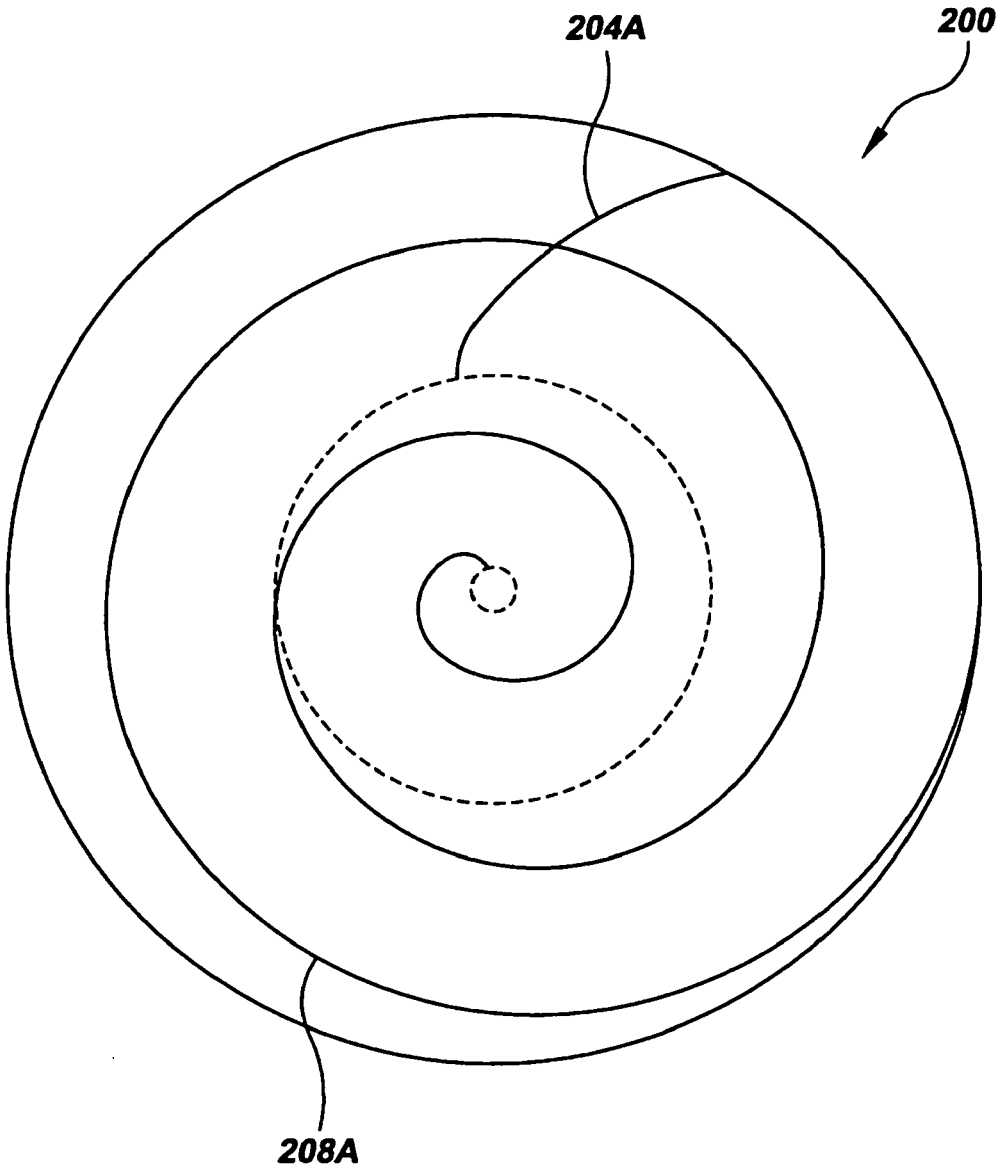
FIG. 5 is a schematic view of the polishing pad of FIG. 4 showing one groove from each of the two sets of crossing grooves.

FIGS. 4-11 illustrate some exemplary alternative polishing pads 200, 300, 400, 450 in accordance with the present invention. FIGS. 4 and 5 illustrate polishing pad 200 having two sets 204, 208 of grooves 204A, 208A in which the grooves wind in opposite directions from one another. For clarity, FIG. 5 particularly shows one each of grooves 204A, 208A. Like grooves 128A, 132A, each groove 204A, 208A may have any transverse cross-sectional configuration suitable for a particular application. Also like grooves 128A, 132B of FIGS. 1-3, grooves 204A, 208B are spiral grooves laid out in accordance with the CF equations, above, so as to provide a constant CF for each groove set 204, 208. As in polishing pad 100 of FIG. 1, crossing grooves 204A, 208A of FIG. 4 define a plurality of landings 212 each having four curved sides defined by curved segments of corresponding respective grooves 204A, 208A. Also as in polishing pad 100 of FIG. 1, the areas of landings 312 of FIG. 4 increase with increasing radial distance from center O of polishing pad 200.

FIGS. 6 and 7 show polishing pad 300 as having two sets 304, 308 of grooves 304A, 308A that are generally the same as corresponding respective grooves 128A, 132A of FIG. 1 and grooves 204A, 208A of FIG. 4. However, in the case of polishing pad 300, as mentioned above grooves 304A and grooves 308A each wind in the same direction about the origin O of the pad. For clarity, FIG. 7 shows one groove 304A, 308A from each set 304, 308. To complete each set 304, 308, each of grooves 304A, 308B shown is simply repeated at a constant angular pitch in a circumferential direction around polishing pad. Grooves 304A, 308A have been provided in accordance with the CF equations, above, so as to provide a constant CF for each groove set 304, 308. As can be seen in FIG. 6, crossing grooves 304A, 308A define a plurality of landings 312 each having four curved sides defined by curved segments of corresponding respective grooves 304A, 308A. Again, the areas of landings 312 increase with increasing radial distance from center O of polishing pad 300.

Figure 8:
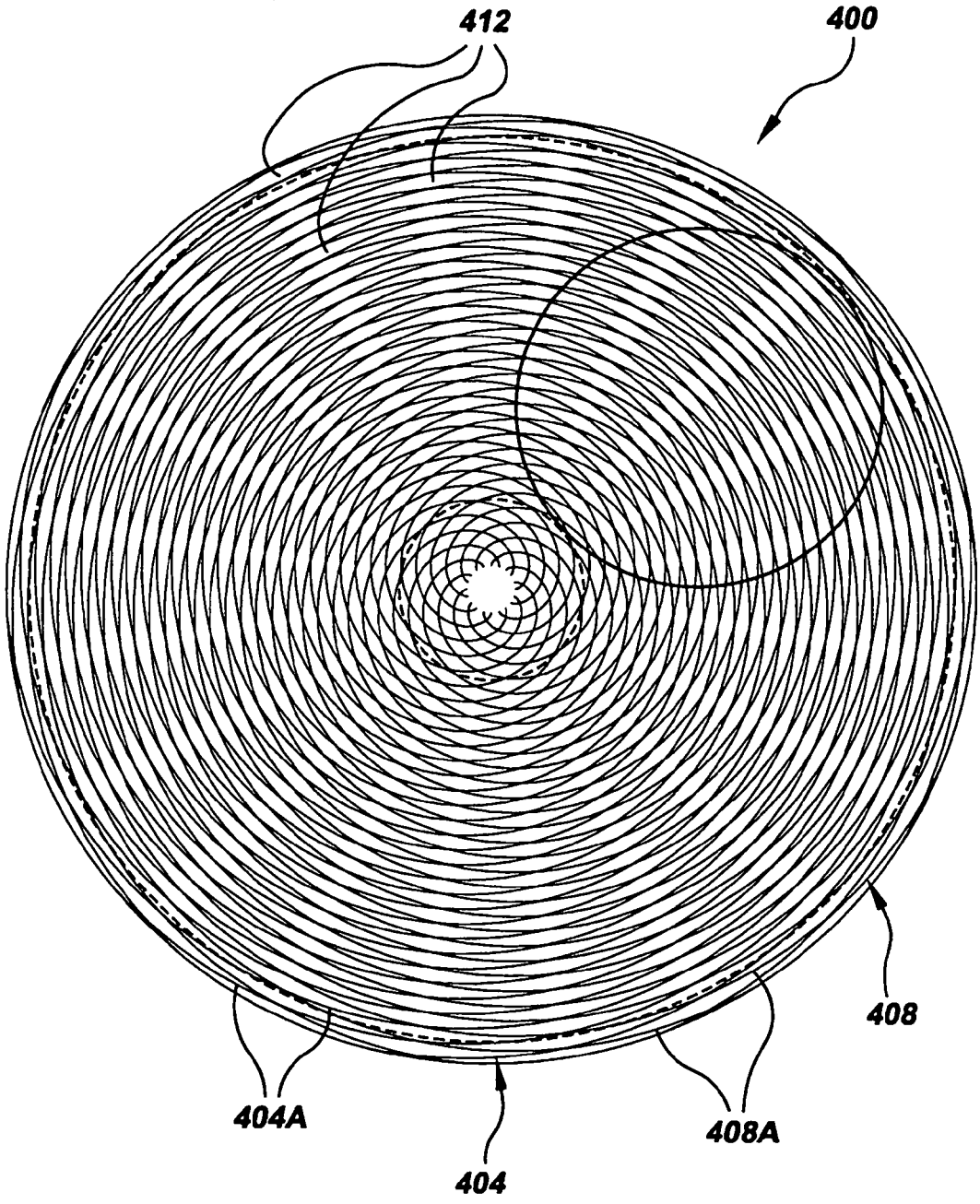
FIG. 8 is a plan view of yet another alternative polishing pad made in accordance with the present invention so as to have two sets of crossing grooves.
Figure 9:
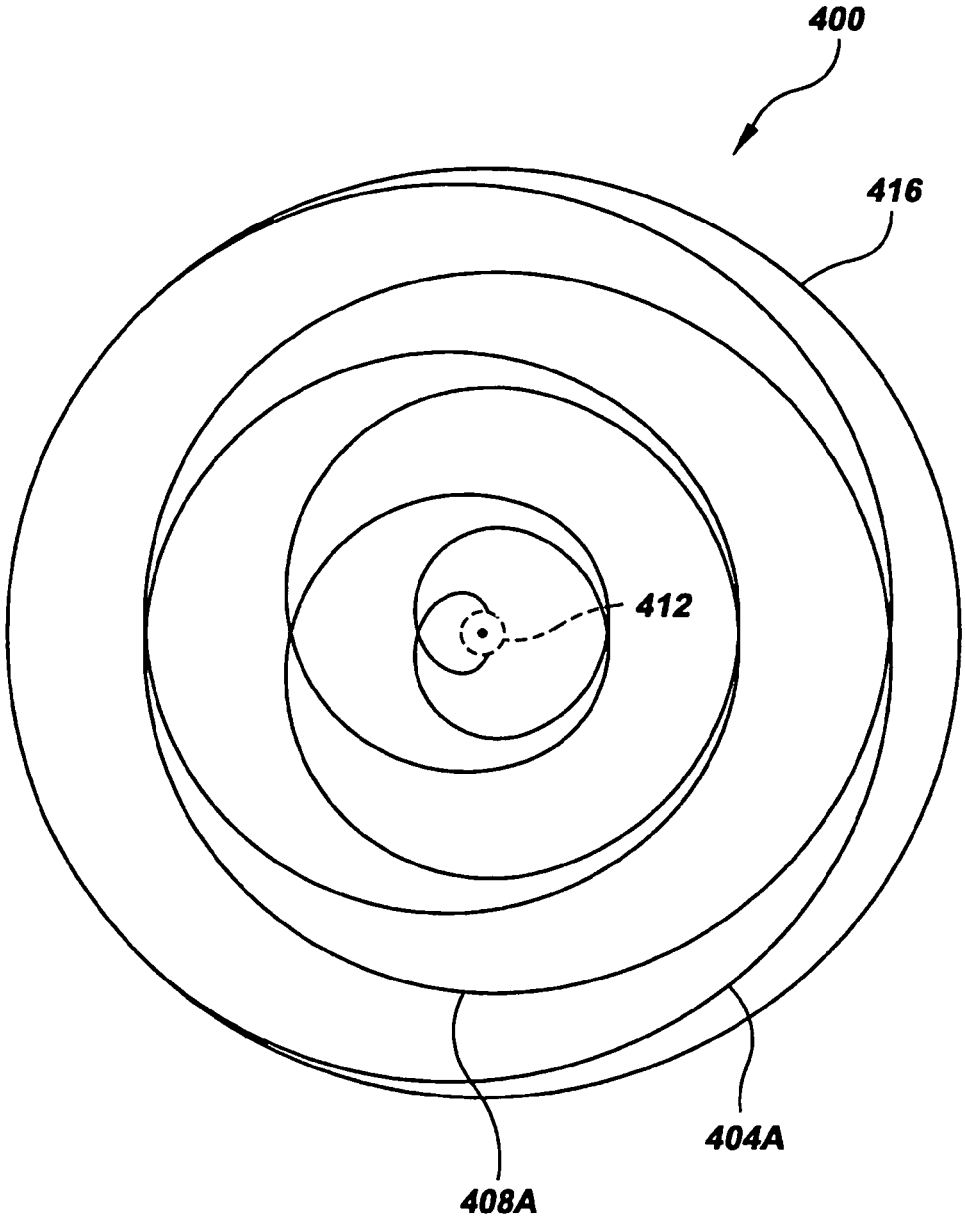
FIG. 9 is a schematic view of the polishing pad of FIG. 8 showing one groove from each of the two sets of crossing grooves.

FIGS. 8 and 9 show polishing pad 400. The groove pattern of polishing pad 400 is essentially based on a single spiral groove shape that is repeated at a constant angular pitch so as to provide a first set 404 of grooves 404A and then mirrored to provide a groove 408A that winds in the opposite direction and is repeated at a constant angular pitch so as to provide a second set 408 of grooves. Polishing pad 400 especially illustrates the fact that the different groove sets, here sets 404, 408, do not need to have differing inner and outer boundaries as in polishing pads 100, 200, 300 of FIGS. 1-7. Rather both sets 404, 408 may share the same inner and outer boundaries 412, 416. Each of grooves 404A, 408A in each set 404, 408 is laid out in accordance with the CF equations, above, thereby providing a substantially constant CF for each groove set 404, 408. Other aspects of grooves 404A, 408A, such as depth, transverse cross-sectional shape and width, may be as described above relative to grooves 128A, 132A of FIGS. 1-3. As can be seen in FIG. 8, crossing grooves 404A, 408A define a plurality of landings 412 each having four curved sides defined by curved segments of corresponding respective grooves 404A, 408A. The areas of landings 412 increase with increasing radial distance from the concentric center of polishing pad 400.

While polishing pad 400 illustrates that two sets 404, 408 of oppositely winding grooves may indeed have the same inner starting radius, in many embodiments it is desirable for polishing medium flow purposes that the grooves in one groove set extend from an inner radius smaller than the inner boundary of the wafer track to an outer radius larger than the outer boundary of the wafer track, while the grooves in another groove set extend from an inner radius located within the wafer track to an outer radius located outside the wafer track. In this manner, the grooves of one set extend entirely through the wafer track and the grooves in the other set extend from inside the wafer track toward the outer periphery of the polishing pad. This situation is shown in each of polishing pads 100, 200, 300, 450 of FIGS. 1-7, 10 and 11.

Figure 10:
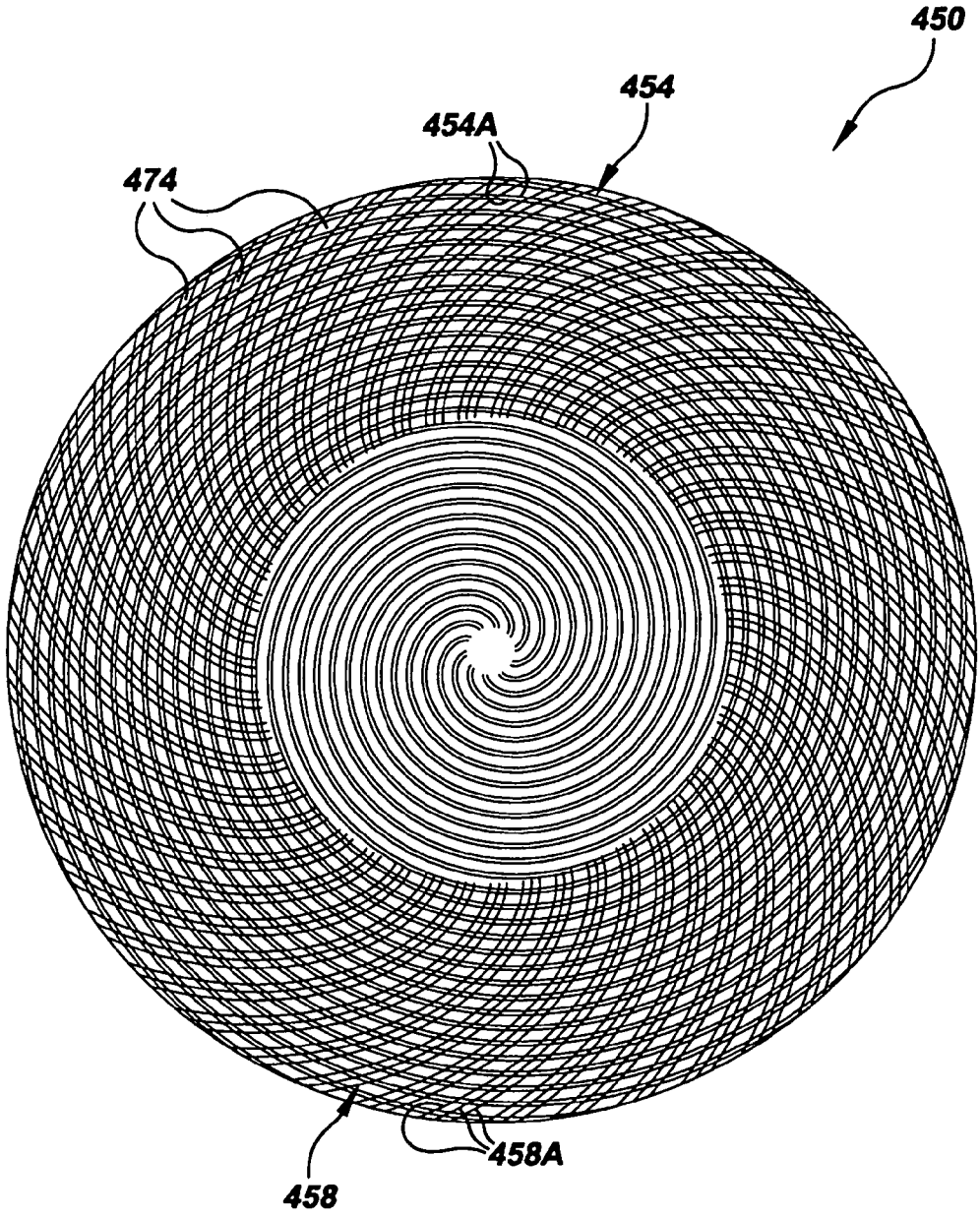
FIG. 10 is a plan view of a further alternative polishing pad made in conformance with the present invention so as to have two sets of crossing grooves, wherein the grooves in each set have a varied angular pitch.
Figure 11:
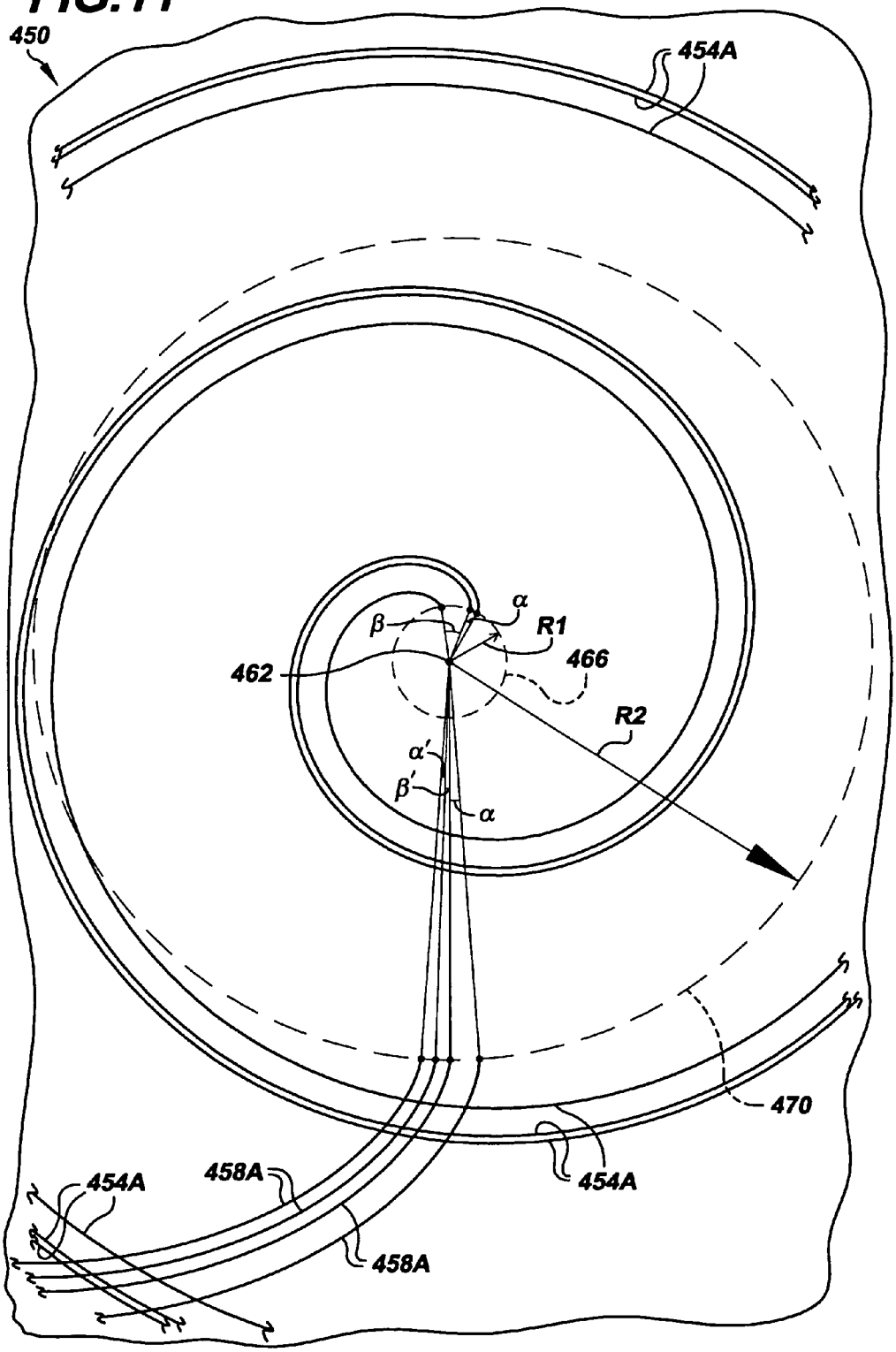
FIG. 11 is an enlarged partial schematic view of the polishing pad of FIG. 10 showing several grooves from each of the two sets of crossing grooves.

FIGS. 10 and 11 show polishing pad 450, which has two sets 454, 458 of crossing constant CF grooves 454A, 458A, respectively. Groove sets 454, 458 are very similar to groove sets 208, 204, respectively, of polishing pad 200 of FIGS. 4 and 5, except that grooves 204A, 208A of FIGS. 4 and 5 in the respective sets 204, 208 of polishing pad 200 are disposed around the pad at a constant angular pitch, whereas grooves 454A, 458A of FIGS. 10 and 11 are disposed around polishing pad 450 at a varied angular pitch. In the exemplary polishing pad 200, there are 20 grooves 208A in groove set 208 (and, consequently, 20 landings between immediately adjacent ones of grooves 208A), yielding a constant angular pitch of 360°/20=18°. Similarly, there are 127 grooves 204A in groove set 204 (and, consequently, 127 landings between immediately adjacent ones of grooves 204A), yielding a constant angular pitch of 360°/127≈2.84°. Of course, in alternative embodiments, the number of grooves 454A, 458A in each set 454, 458 may be different from the number shown and may be selected to be as many or as few as a particular design requires.

Referring to FIGS. 10 and 11, in groove set 454 of polishing pad 450, on the other hand, grooves 454A have a varied angular pitch that alternates between $\alpha=9°$ and $\beta=27°$. Since $\alpha$ is relatively much smaller than $\beta$, human visual perception tends to group the closely spaced grooves together, in this case making groove set 454 to appear to contain ten sets of two grooves 454A each. Similarly, grooves 458A in groove set 458 have a varied pitch that is a repeating series of three angles $\alpha'$, $\beta'$, $\gamma$, where $\alpha'=\beta'=2°$ and $\gamma=4°$. Here, too, human visual perception tends to group the more closely spaced grooves 458A together so that groove set 458 appears to contain 45 sets of three grooves 458A each. Of course, those skilled in the art will readily appreciate that these two varied angular pitches are merely exemplary and that many varied-pitch groove patterns can be contrived by anyone skilled in the art by using two or more differing pitch angles in each groove set 454, 458. Of course, in other embodiments, only one of groove sets 454, 458 may be provided with varying groove pitch while the other is provided with a constant pitch.

As with grooves 128A, 132A of polishing pad 100 of FIGS. 1-3, each groove 454A, 458A in each respective groove set 454, 458 is laid out in accordance with the CF equations discussed above, i.e., Equations {1}-{3}, thereby providing a substantially constant CF for each groove set 454, 458. Referring particularly to FIG. 11, point 462 represents the concentric center of polishing pad 450, circle 466 indicates the starting point for grooves 454A of groove set 454 and circle 470 indicates the starting point for grooves 458A of groove set 458. Circles 466, 470 are concentric with center point 462, with circle 466 having a radius R1 and circle 470 having a radius R2. It is noted that although radius R1 is shown as being smaller than radius R2, those skilled in the art will appreciate that in other embodiments radius R1 may be greater than radius R2 and, since grooves 454A wind in the opposite direction from grooves 458A, in yet other embodiments radius R1 may be equal to R2. Regarding the latter, it will be recognized that since grooves 454A, 458A are defined by the same equations, if they were to wind in the same direction and have the same starting radius, they would have identical spiral shapes and would not cross one another. Other aspects of grooves 454A, 458A, such as depth, transverse cross-sectional shape and width, may be as described above relative to grooves 128A, 132A of FIGS. 1-3. In addition, as can be seen in FIG. 10, crossing grooves 454A, 458A define a plurality of landings 474 each having four curved sides defined by curved segments of corresponding respective grooves 454A, 458A. Polishing pads 100, 200, 300, 400 depicted in FIGS. 1, 4, 6, and 8, respectively, the areas of landings 474 increase with increasing radial distance from the concentric center 462 of polishing pad 450.

It should be noted that while the foregoing examples have featured groove sets in which the individual grooves are equally spaced in the angular direction, this need not be so. It is generally desirable that some periodicity be present in the spacings of individual grooves of the first and second set of constant-area spiral grooves, but this may be realized in groups of two, three, or more grooves of each set rather than a single groove pitch around the entire pad.

Figure 12:
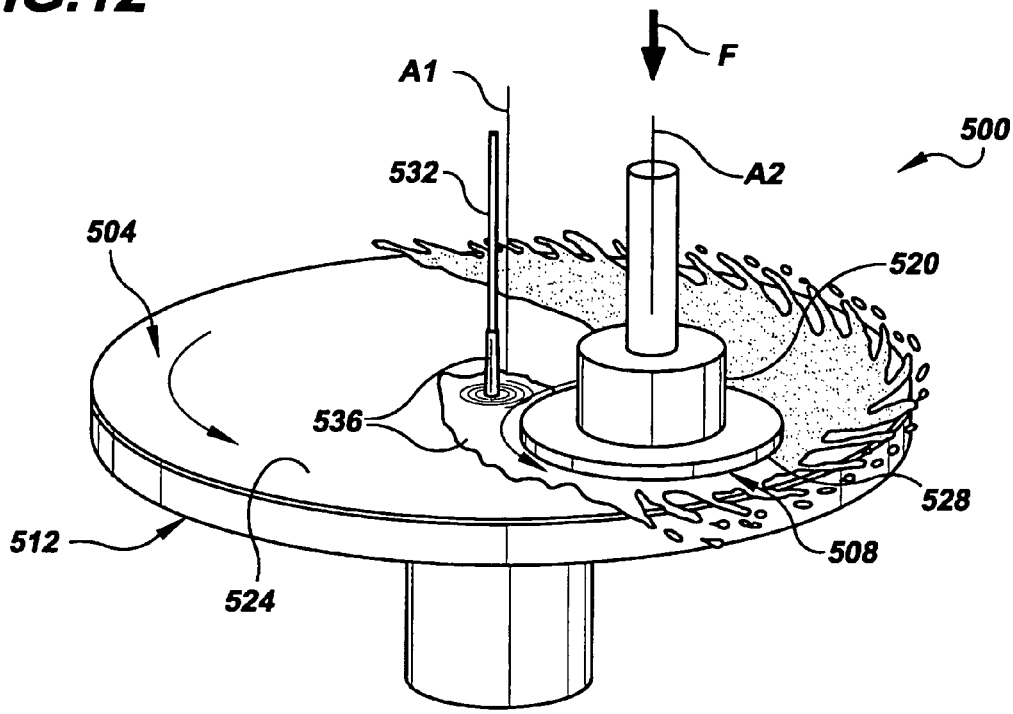
FIG. 12 is a schematic diagram of a polishing system in accordance with the present invention.

FIG. 12 illustrates a polisher 500 suitable for use with a polishing pad 504, which may be one of polishing pads 100, 200, 300, 400, 450 of FIGS. 1-11 or other polishing pad made in accordance with the present invention, for polishing an article, such as a wafer 508. Polisher 500 may include a platen 512 on which polishing pad 504 is mounted. Platen 512 is rotatable about a rotational axis A1 by a platen driver (not shown). Polisher 500 may further include a wafer carrier 520 that is rotatable about a rotational axis A2 parallel to, and spaced from, rotational axis A1 of platen 512 and supports wafer 508 during polishing. Wafer carrier 520 may feature a gimbaled linkage (not shown) that allows wafer 508 to assume an aspect very slightly non-parallel to the polishing surface 524 of polishing pad 504, in which case rotational axes A1, A2 may be very slightly askew relative to each other. Wafer 508 includes a polished surface 528 that faces polishing surface 524 and is planarized during polishing. Wafer carrier 520 may be supported by a carrier support assembly (not shown) adapted to rotate wafer 508 and provide a downward force F to press polished surface 524 against polishing pad 504 so that a desired pressure exists between the polished surface and the pad during polishing. Polisher 500 may also include a polishing medium inlet 532 for supplying a polishing medium 536 to polishing surface 524.

As those skilled in the art will appreciate, polisher 500 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 508 and polishing pad 504; (2) controllers and selectors for varying the rate and location of delivery of polishing medium 536 to the pad; (3) controllers and selectors for controlling the magnitude of force F applied between the wafer and polishing pad, and (4) controllers, actuators and selectors for controlling the location of rotational axis A2 of the wafer relative to rotational axis A1 of the pad, among others. Those skilled in the art will understand how these components are constructed and implemented such that a detailed explanation of them is not necessary for those skilled in the art to understand and practice the present invention.

During polishing, polishing pad 504 and wafer 508 are rotated about their respective rotational axes A1, A2 and polishing medium 536 is dispensed from polishing medium inlet 532 onto the rotating polishing pad. Polishing medium 536 spreads out over polishing surface 524, including the gap beneath wafer 508 and polishing pad 504. Polishing pad 504 and wafer 508 are typically, but not necessarily, rotated at selected speeds of 0.1 rpm to 150 rpm. Force F is typically, but not necessarily, of a magnitude selected to induce a desired pressure of 0.1 psi to 15 psi (6.9 to 103 kPa) between wafer 508 and polishing pad 504.

The complementary circumference fraction spiral groove design of the invention facilitates wafer uniformity. In particular, initiating a first circumference fraction groove outside the wafer track and a second circumference fraction spiral groove in the wafer track can further improve wafer uniformity. Furthermore, increasing groove density can improve the polishing pads' slurry distribution. Finally, the second set of grooves may increase or decrease the removal rate, depending upon the polishing behavior of the slurry. For example, slurry behavior varies widely with polishing conditions; and some slurries increase removal rate with increased flow rate and some slurries decrease removal rate with increased flow rate.

The invention claimed is:

1. A polishing pad, comprising:

a polishing layer configured for polishing at least one of a magnetic, optical and semiconductor substrate in the presence of a polishing medium, the polishing layer including a circular polishing surface having a concentric center and an outer periphery;

at least one first groove formed in the circular polishing surface; and a groove set formed in the circular polishing surface so as to cross the at least one first groove at least twice so as to define at least one four-sided landing having four curved sides;

wherein each of the at least one first groove and the at least one second groove provide the circular polishing surface with a respective circumference fraction grooved from a first location proximate the concentric center to a second location proximate the outer periphery, the respective circumference fraction grooved having an average and remaining within about 25% of the average.

2. The polishing pad according to claim 1, wherein the at least one first groove has a first starting radius and a first spiral shape defined by a set of constant circumference fraction grooved equations as a function of the first starting radius and the groove set has a second starting radius and a second spiral shape defined by the set of constant circumference fraction grooved equations as a function of the second starting radius.

3. The polishing pad according to claim 2, wherein the polishing surface has an annular wafer track when the polishing pad is used for polishing, the first starting radius being located between the concentric center of the polishing surface and the wafer track and the second starting radius lying within the wafer track.

4. The polishing pad according to claim 2, wherein the at least one first groove winds in a first direction about the concentric center of the circular polishing surface and the groove set winds in a second direction about the concentric center opposite the first direction.

5. The polishing pad according to claim 1, further comprising a plurality of first grooves providing the respective constant circumference fraction grooves, the plurality of first grooves having a varied angular pitch among the plurality of first grooves.

6. The polishing pad according to claim 1, wherein the circumference fraction grooved of each of the at least one first groove and the groove set has an average and remains within about 10% of the average.

7. A polishing pad, comprising:

a polishing layer configured for polishing at least one of a magnetic, optical and semiconductor substrate in the presence of a polishing medium, the polishing layer including a circular polishing surface having a concentric center and an outer periphery;

a first groove set having a first starting radius and containing a plurality of first grooves formed in the circular polishing surface, each of the plurality of first grooves laid out in accordance with a set of constant circumference fraction grooved equations as a function of the first starting radius so as to provide a first circumference fraction grooved having a first average and remaining within about 5% of the first average; and a second groove set having a second staring radius and containing a plurality of second grooves formed in the circular polishing surface so that ones of the plurality of first grooves cross ones of the plurality of second grooves at least once so as to define a plurality of four-sided landings each having four curved sides, each of the plurality of second grooves laid out in accordance with the set of constant circumference fraction grooved equations as a function of the second starting radius so as to provide a second circumference fraction grooved having a second average and remaining within about 5% of the second average.

8. The polishing pad according to claim 7, wherein said first starting radius is less than about 1/12 of the pad outer radius in order to provide each spiral groove in the first groove set with at least two full turns.

9. The polishing pad according to claim 8, wherein said second starting radius is greater than about 1/3 of the pad outer radius in order to provide each spiral groove in the second groove set with no more than one full turn.

10. The polishing pad according to claim 8, wherein said second starting radius is less than about 1/12 of the pad outer radius in order to provide each spiral groove in the second groove set with at least two full turns.

* * * * *

UNITED STATES PATENT AND TRADEMARK OFFICE

CERTIFICATE OF CORRECTION

PATENT NO. : 7,300,340 B1
APPLICATION NO. : 11/512699
DATED : November 27, 2007
INVENTOR(S) : Elmufdi et al.

It is certified that error appears in the above-identified patent and that said Letters Patent is hereby corrected as shown below:

Column 5, line 15, replace "Ro" with --R0--.
Column 10, line 34 and 35, Claim l, replace "at least one second groove" with --groove set--.

Signed and Sealed this

Twenty-first Day of September, 2010

David J. Kappos

David J. Kappos
*Director of the United States Patent and Trademark Office*